US005316658A

United States Patent [19]

Ushio et al.

[11] Patent Number: 5,316,658

[45] Date of Patent: May 31, 1994

[54] PROCESS FOR THE PRODUCTION OF LOW-SULFUR DIESEL GAS OIL

[75] Inventors: Masaru Ushio; Tamio Nakano; Minoru Hatayama; Katuhiko Ishikawa; Masaru Sato, all of Yokohama, Japan

[73] Assignees: Nippon Co., Ltd.; Nippon Petroleum Refining Co., Ltd., Japan

[21] Appl. No.: 914,847

[22] Filed: Jul. 15, 1992

[30] Foreign Application Priority Data

Jul. 19, 1991 [JP] Japan ..... 3-203505
Dec. 20, 1991 [JP] Japan ..... 3-355157

[51] Int. Cl.[5] ..... C10G 45/04

[52] U.S. Cl. ..... 208/216 R; 208/15; 208/210; 208/217

[58] Field of Search ..... 208/216 R, 210, 217, 208/15

[56] References Cited

U.S. PATENT DOCUMENTS 3,392,112 7/1968 Bercik et al. ..... 208/210
3,841,995 10/1974 Bertolacini et al. ..... 208/210
3,844,932 10/1974 Gomi et al. ..... 208/57
4,048,060 9/1977 Riley ..... 208/210
4,629,553 12/1986 Hudson et al. ..... 208/212

FOREIGN PATENT DOCUMENTS 1545423 1/1970 Fed. Rep. of Germany .
1326659 4/1962 France .
2337195 7/1977 France .
1152636 5/1969 United Kingdom .
9216601 10/1992 World Int. Prop. O. .

*Primary Examiner*—R. Bruce Breneman
*Assistant Examiner*—Patricia L. Hailey
*Attorney, Agent, or Firm*—Ostrolenk, Faber, Gerb & Soffen

[57] ABSTRACT

A process for the production of a low-sulfur diesel gas oil having a sulfur content of 0.05% by weight or lower and having a Saybolt color number of −10 or higher, from a petroleum distillate having a sulfur content of 0.1 to 2.0% by weight and having an inferior color and inferior oxidation stability comprises contacting the petroleum distillate with hydrogen in the presence of a hydro-treating catalyst which has at least one metal supported on said porous carrier, at a temperature of 350° to 450° C., and a pressure of 45 to 100 kg/cm$^2$ in the first step to thereby produce materials having a sulfur content of 0.05% by weight or lower, and contacting further the materials issued from the first step with hydrogen in the presence of a hydro-treating catalyst which has at least one metal supported on said porous carrier, at a temperature of 200° to 300° C., and a pressure of 45 to 100 kg/cm$^2$ in the second step to thereby produce the finished low-sulfur diesel gas oil.

6 Claims, No Drawings

PROCESS FOR THE PRODUCTION OF LOW-SULFUR DIESEL GAS OIL

BACKGROUND OF THE INVENTION (1) Field of the Invention

The invention relates to a process for the production of a low-sulfur diesel gas oil having a low-sulfur content and a good color from a petroleum distillate. More particularly, the invention relates to a process for the production of a low-sulfur diesel gas oil having a sulfur content of 0.05% by weight or lower and having a Saybolt color number of −10 or higher, from a petroleum distillate having a sulfur content of 0.1 to 2.0% by weight and having an inferior color and inferior oxidation stability.

(2) Description of the Prior Art

At present, domestic diesel gas oils are produced by blending a desulfurized gas oil fraction obtained by conventional desulfurization of a straight-run gas oil with a straight-run gas oil fraction, a straight-run kerosine fraction, a gas oil fraction obtained by petroleum cracking, or the like to thereby provide a product having a sulfur content of 0.4 to 0.5% by weight.

Recently, due to rising concern regarding environmental problems, further reduction of $NO_x$ and particulate matter evacuated with exhaust fumes from diesels is required.

The basic requirements requested to the petroleum manufacturers are as follows:

1. First, the sulfur content of 0.4 to 0.5% by weight as set forth in the present standards must be lowered to the first-phase targeted exhaust fume standard of 0.2% by weight.

2. The sulfur content of 0.2% by weight must be further lowered to the second-phase targeted standard of 0.05% by weight in stages.

3. As for the color, no targeted standards have been fixed yet; however, each oil refining company has been carrying out quality control for diesel oils by setting a reference standard for color in various scales such as Saybolt, ASTM, APHA color numbers, or the like from an independent standpoint.

Especially, cracked gas oils used as a base gas oil, for which a large increase in demand in the future has been forecasted, are very poor in color; therefore, a distinct improvement on the present color level is also required. Japanese Patent Laid-Open Application No. 3-86793 proposes a two-step hydro-treating process for the production of a diesel gas oil having a sulfur content of 0.2% by weight or lower which is the first-phase targeted standard. However, under the conditions of the process such as a pressure of 10 to 40 kg/cm$^2$, a temperature of 280° to 370° C., a liquid hourly space velocity, LHSV, of 0.5 to 5.0 hr$^{-1}$ in the first step, and a pressure of 10 to 40 kg/cm$^2$, a temperature of 150° to 325° C., an LHSV of 0.5 to 5.0 hr$^{-1}$ in the second step, it is extremely difficult to meet the second-phase targeted standard of sulfur content of 0.05% by weight.

Further, under a pressure of 40 kg/cm$^2$ or lower in the second reactor in this case, it is extremely difficult to meet the requirement for color i.e. the reference standard for the color of finished products, because the desulfurized oil to be fed into the second step has already been treated at a much higher temperature in the first step in order to meet a sulfur content of 0.05% by weight and thus has a poor color. Such difficulty is encountered especially remarkably in hydro-treating of a cracked gas oil which is not good in color.

U.S. Pat. No. 4,755,280 teaches a two-step hydro-treating process for improving the color or oxidation stability of hydrocarbon compounds wherein an Fe-type catalyst is employed in the second reactor in order to improve the color and oxidation stability. However, it is known that the hydro-treating activity of the Fe-type catalyst is readily poisoned with hydrogen sulfide and the like (Japanese Patent Laid-Open Application No. 62-84182). Therefore, the amounts of sulfur and nitrogen compounds such as hydrogen sulfide and ammonium present in the feedstock to be fed to the second step must be lowered to a total amount of about 10 ppm or lower prior to feeding.

As it is seen from the description of the above process, when sulfur and nitrogen compounds such as hydrogen sulfide and ammonium present in the materials issued from the first step must be removed prior to feeding the materials into the second step, it is necessary to install additional units such as a vapor-liquid separator, a stripper for the stripping of the absorbed hydrogen sulfide and ammonium from the rich oil, and a washing tower for the removal of these compounds present in the rich gas; therefore, a commercial plant of this type is very costly, and increases the costs of operation unpreferably.

U.S. Pat. No. 3,841,995 proposes a two-step hydro-treating process for the improvement of the color and odor of hydrocarbon compounds. However, in the process a noble metal catalyst such as Pt is employed in the second reactor; thus, the hydro-refining activity of the catalyst is readily poisoned by hydrogen sulfide and the like. Therefore, it is necessary to remove the sulfur and nitrogen compounds such as hydrogen sulfide and ammonium present in the materials issued from the first step to thereby provide a hydrogen sulfide- and ammonium-free feedstock to be fed to the second step. This is costly in a similar manner as described for the process disclosed by U.S. Pat. No. 4,755,280.

SUMMARY OF THE INVENTION

Accordingly, it is the principal object of the present invention to provide an improved process for the production of a low-sulfur diesel gas oil from a petroleum distillate, wherein the distillate as a feedstock has a sulfur content of 0.1 to 2.0% by weight and is poor in color and oxidation stability, and the low-sulfur diesel gas oil as a finished product has a sulfur content of 0.05% by weight or lower (the second-phase targeted standard) and a color number of −10 or higher (reference standard).

The process of the present invention is based on two-step hydro-treating of a petroleum distillate under specific conditions to thereby produce a low-sulfur diesel gas oil having a good color number.

In particular the present invention relates to a process for the production of a low-sulfur diesel gas oil from a petroleum distillate having a sulfur content of 0.1 to 2.0% by weight and a boiling point of 150° to 400° C., wherein the process comprises contacting the petroleum distillate with hydrogen in the presence of a hydro-treating catalyst which has at least one metal and a porous carrier, wherein said metal has a hydro-treating activity and is supported on said porous carrier, at a temperature of 350° to 450° C. and a pressure of 45 to 100 kg/cm$^2$ in the first step to thereby produce materials having a sulfur content of 0.05% by weight or lower;

and further contacting the materials issued from the first step with hydrogen in the presence of a hydro-treating catalyst which has at least one metal and a porous carrier, wherein said metal has a hydro-treating activity and is supported on said porous carrier, at a temperature of 200° to 300° C. and a pressure of 45 to 100 kg/cm$^2$ in the second step to thereby produce a finished product having a Saybolt color of −10 or lower.

DETAILED DESCRIPTION OF THE INVENTION

The petroleum distillates employed in the present invention have sulfur contents of 0.1 to 0.2% by weight and boiling points of 150° to 400° C. Examples of the distillates include a distillate obtained by topping or vacuum distillation of crude oils, a distillate obtained by fractionation of fluid catalytic cracking oils (FCC oils), a distillate obtained by fractionation of thermal cracking oils, and mixtures thereof. Among them, a blend of a distillate obtained by fractionation of an FCC oil or a thermal cracking oil with a distillate obtained by topping or vacuum distillation of a crude oil is employed preferably.

The blend ratio of the distillate obtained by fractionation of an FCC oil or a thermal cracking oil to the distillate obtained by topping or vacuum distillation of a crude oil is 1:90 to 99:1, preferably 10:90 to 50:50.

In the present invention, hydrodesulfurization is carried out mainly in the first step and hydro-treating to improve the color of feedstock is carried out mainly in the second step.

The hydrodesulfurization temperature of the first step is 350° to 450° C., preferably 360° to 400° C. When the temperature is lower than 350° C., the sulfur content of 0.05% by weight, which is the second-phase targeted standard, is difficult to attain; inversely, when the temperature is higher than 450° C., a Saybolt color number of −10 or higher, which is the reference color number, is difficult to attain in the second step, because a deeply colored oil is obtained in the first step.

The term "hydro-treating temperature" in the first step refers to the outlet temperature of the catalyst bed.

The hydro-treating pressure in the first step is 45 to 100 kg/cm$^2$, preferably 50 to 70 kg/cm$^2$.

The term "hydro-treating pressure" in the first step refers to the hydrogen partial pressure.

In the first step the preferred LHSV is 1 to 10 hr$^{-1}$, preferably 4 to 8 hr$^{-1}$.

The preferable hydrogen/oil ratio in the first step is 200 to 5000 scf/bbl, more preferably 500 to 2000 scf/bbl.

As for the hydro-treating catalyst in the first step, said catalyst, which has at least one metal and a porous carrier, wherein said metal has a hydro-treating activity and is supported on a porous inorganic oxide carrier, is employed. The catalyst is a conventional one which is usually used for the hydro-refining of petroleum distillates.

Examples of the porous inorganic carriers include alumina, silica, titania, boria, zirconia, silica-alumina, silica-magnesia, alumina-magnesia, alumina-titania, silica-titania, alumina-boria, alumina-zirconia, and the like, with the alumina and silica-alumina being preferred.

Examples of said metals having hydro-treating activity include the metals of Groups VI and VIII. Among them, Cr, Mo, W, Co, Ni, Fe, and mixtures thereof are preferred, with the Co-Mo or Ni-Mo being more preferred.

These metals are employed in the forms of the metal itself, its oxide, its sulfide, or mixtures thereof, supported on the carrier.

The most preferred catalyst employed in the first step of the present invention is a Co-Mo or Ni-Mo catalyst having a hydro-treating activity, the metals being highly dispersed on the alumina carrier.

To disperse the catalytic active metal on a carrier, any conventional dispersion methods such as impregnation, co-precipitation, and the like may be employed.

The amount of active metal on the surface of the catalyst as an oxide is preferably 1 to 30% by weight, preferably 3 to 20% by weight.

These catalysts may be employed in the forms of granule, tablet or cylinder.

The hydro-treating catalyst in the first step may be subjected to presulfiding by a conventional means prior to use.

In the first step, any type of hydrotreating reactor, such as a fixed bed, fluidized bed and expansion bed, may be employed with the fixed bed being preferred.

In the first step, any type of contact among the catalyst, the feedstock and hydrogen, such as concurrent upflow, concurrent downflow, and countercurrent, may be employed.

In the first step, the hydro-treating is carried out so as to provide materials having a sulfur content of 0.05% by weight or lower.

In the process of the present invention, essentially all the materials issued from the first step such as liquid and gaseous materials are fed into the second step in order to be subjected to further hydro-treating; that is to say, all the materials issued from the first step are fed directly into the second step without removing lighter fractions such as hydrogen sulfide and ammonium dissolved in the materials by stripping or the like.

The hydro-treating temperature in the second step is 200° to 300° C., preferably 220° to 275° C., more preferably 230° to 250° C.

When the temperature is lower than 200° C., a Saybolt color number of −10 or higher (reference color number) is difficult to attain; conversely, when the temperature is higher than 300° C., a Saybolt color number of −10 or higher is also difficult to attain.

The term "hydro-treating temperature" in the second step refers to the outlet temperature of the catalyst bed. In the second step the hydro-treating pressure is 45 to 100 kg/cm$^2$, preferably 50 to 70/cm$^2$.

Further, in the second step the preferable hydro-treating pressure is the same as the pressure in the first step or higher.

The term "hydro-treating pressure" in the second step refers to the hydrogen partial pressure.

The preferred hydrogen partial pressure in the second step is the same as the hydrogen partial pressure in the first step or higher.

In the second step the preferable LHSV is 1 to 200 hr$^{-1}$, preferably 4 to 20 hr$^{-1}$.

The preferable hydrogen/oil ratio in the second step is 200 to 5000 scf/bbl, more preferably 500 to 2000 scf/bbl.

The same catalyst as the one used in the first step may be employed as the hydro-treating catalyst in the second step.

A catalyst different from the one used in the first step may be also used in the second step. For example, when Co-Mo is employed as the catalytic active metal in the first step, Ni-Mo is employed as the catalytic active metal in the second step; inversely, when Ni-Mo is employed in the first step, Co-Mo may be employed as the catalytic active metal in the second step.

These hydro-treating catalysts may be subjected to presulfiding prior to use by a conventional means.

In the second step, any type of hydro-treating reactor may be employed such as a fixed bed, fluidized bed, expansion bed, with the fixed bed being preferred.

In the second step any type of contact among the catalyst, the feed stock and hydrogen, such as concurrent upflow, concurrent downflow, and countercurrent, may be employed.

In the present invention, the first step is connected with the second step in series which, however by no means limits the invention. For example, the run of the first step may be carried out separately from the run of the second step.

In the second step the hydro-treating is carried out so that the finished product can have a sulfur content of 0.05% by weight or lower, and a Saybolt color number of −10 or higher, preferably 0 or higher.

The crude product issued from the second reactor is thereafter subjected to a vapor-liquid separation, and the liquid material separated is then stripped to remove lighter fractions comprising sulfur compounds such as hydrogen sulfide and nitrogen compounds such as ammonium and the like.

The following examples will further illustrate the present invention, which by no means limit the invention.

EXAMPLE 1

A blended feedstock (blend ratio=1:1) comprising a distillate obtained by topping of a crude oil and a distillate obtained by fractionation of a fluid catalytic cracking oil (an FCC oil) was subjected to two-step hydro-treating under the conditions as set forth in Table 1. The blended feedstock had a sulfur content of 1.1% by weight and a boiling point of 150° to 400° C.

A commercial hydro-treating catalyst comprising 5% by weight of CoO and 15% by weight of $MoO_3$, based on the total weight of catalyst, supported on an alumina carrier was employed in the first and second steps.

These catalysts were used after presulfiding by a conventional means. The two-step hydro-treating was carried out continuously in first and second step reactors which had been connected in series. The liquid and gaseous materials obtained by the first step hydro-treating were directly fed into the second step to be subjected to further hydro-treating. The results are set forth in Table 1.

EXAMPLE 2

A blended feedstock (blend ratio=1:1) comprising a distillate obtained by topping of a crude oil and a distillate obtained by fractionation of an FCC oil was subjected to two step hydro-treating under the conditions as set forth in Table 1. The blended feedstock had a sulfur content of 1.1% by weight and a boiling point of 150° to 400° C.

A commercial hydro-treating catalyst comprising 5% by weight of NiO and 15% by weight of $MoO_3$, based on the total weight of catalyst, supported on an alumina carrier was employed in the first and second steps.

These catalysts were used after presulfiding by a conventional means. The two-step hydro-treating was carried out continuously in first and second step reactors which had been connected in series. The liquid and gaseous materials issued from the first step were directly fed to the second step to be subjected to further hydro-treating. The results are set forth in Table 1.

EXAMPLE 3

A distillate obtained by topping of a crude oil was subjected to two-step hydro-treating under the conditions as set forth in Table 1. The distillate had a sulfur content of 1.2% by weight and a boiling point of 150° to 400° C.

A commercial hydro-treating catalyst comprising 5% by weight of CoO and 15% by weight of $MoO_3$, based on the total weight of catalyst, supported on an alumina carrier was employed in the first step.

A commercial hydro-treating catalyst comprising 5% by weight of NiO and 15% by weight of $MoO_3$, based on the total weight of catalyst, supported on an alumina carrier was employed in the second step.

These catalysts were used after presulfiding by a conventional means. The two-step hydro-treating was carried out continuously in first and second step reactors which had been connected in series. The liquid and gaseous materials issued from the first step were directly fed into the second reactor to be subjected to further hydro-treating. The results are set forth in Table 1.

EXAMPLE 4

A distillate obtained by topping of a crude oil was subjected to two-step hydro-treating under the conditions as set forth in Table 1. The distillate had a sulfur content of 1.0% by weight and a boiling point of 150° to 400° C.

A commercial hydro-treating catalyst comprising 5% by weight of NiO and 15% by weight of $MoO_3$, based on the total weight of catalyst, supported on an alumina carrier was employed in the first step.

A commercial hydro-treating catalyst comprising 5% by weight of $CoO_3$ and 15% by weight of $MoO_3$, based on the total weight of catalyst, supported on an alumina carrier was employed in the second step.

These catalysts were used after presulfiding by a conventional means. The two-step hydro-treating was carried out continuously in first and second step reactors which had been connected in series. The liquid and gaseous materials issued from the first step were directly fed to the second step to be subjected to further hydro-treating. The results are set forth in Table 1.

COMPARATIVE EXAMPLE 1

In order to make clear the effect of low-temperature hydro-treating in the second step, one-step hydro-treating was carried out. The results are set forth in Table 1.

Although the sulfur content of the final product met the targeted standard of the present invention, the color did not meet the reference standard.

In order to make both the color and sulfur content of the final product meet the targeted and reference standards at an operating pressure of 60 kg/cm$^2$, it was necessary to carry out the hydro-treating at a much lower temperature to thereby prevent coloration of the final product; however, such low-temperature operation is unfavorable to desulfurization.

As a result, in a commercial plant of this process it is necessary to operate the plant at a very low liquid hourly space velocity, LHSV, unpreferably.

COMPARATIVE EXAMPLE 2

In order to make clear the effect of low-temperature hydro-treating in the second step, one-step hydro-treating was carried out. The results are set forth in Table 1.

Although the sulfur content of the final product met the targeted level of the present invention, the color did not meet the reference standard.

COMPARATIVE EXAMPLE 3

In order to make clear the effect of low-temperature hydro-treating in the second step, one-step hydro-treating was carried out. The results are set forth in Table 1.

Although the sulfur content met the targeted standard of the present invention, the color did not meet the reference standard.

In order to make both the color and sulfur content meet the targeted and reference standards at an operating pressure of 100 kg/cm$^2$, it was necessary to carry out the hydro-treating at a much lower temperature to thereby prevent the coloration of the final product; however, such low-temperature operation is unfavorable to desulfurization.

As a result, in a commercial plant of this process it is necessary to operate the plant at a very low LHSV unpreferably.

COMPARATIVE EXAMPLE 4

In this reference, the pressure and temperature conditions in the first step did not come within the scope of the present invention. Table 1 gives the results.

Although the sulfur content met the targeted level of the present invention, the color did not meet the reference standard. When the pressure in the second step was 30 kg/cm$^2$, the improvement effect on color could not be observed; therefore, it was necessary to operate the pressure at 45 kg/cm$^2$ or higher in order to exert fully the color improvement effect.

COMPARATIVE EXAMPLE 5

This Example was carried out in order to make clear that it is necessary to remove hydrogen sulfide from the feedstock when a noble metal catalyst such as Pt-catalyst is employed in the second step as the hydro-treating catalyst. The results are set forth in Table 1.

As can be seen from Table 1, when 2% by volume of hydrogen sulfide is present in the feedstock to be fed to the second reactor, the color improvement effect of the two-step hydro-treating cannot not be observed.

In Comparative Examples I to V, the feedstocks were the same as in Example I.

The examples explained here clearly demonstrate that the two-step hydro-treating process of the present invention proves to serve as a suitable commercial process for the production of a low-sulfur diesel gas oil, wherein the process can make both the sulfur content and color of gas oil products meet the targeted and reference standards respectively.

TABLE 1

| | Example | | | | Comparative Example | | | | |
|---|---|---|---|---|---|---|---|---|---|
| | 1 | 2 | 3 | 4 | 1 | 2 | 3 | 4 | 5 |
| First Step Hydro-treating Reaction Conditions: | | | | | | | | | |
| Catalyst | Co—Mo | Ni—Mo | Co—Mo | Ni—Mo | Co—Mo | Co—Mo | Co—Mo | Co—Mo | Co—Mo |
| $H_2$ Partial Pressure (kg/cm$^2$) | 60 | 60 | 60 | 60 | 60 | 100 | 100 | 30 | 60 |
| Temp. (°C.) | 375 | 400 | 380 | 380 | 375 | 375 | 320 | 360 | 375 |
| LHSV (hr$^{-1}$) | 4 | 4 | 4 | 4 | 2 | 2 | 2 | 4 | 4 |
| $H_2$/oil (scf/bbl) | 2000 | 2000 | 2000 | 2000 | 2000 | 2000 | 2000 | 2000 | 2000 |
| Properties of Finished Oil: | | | | | | | | | |
| S (wt %) | 0.047 | 0.006 | 0.042 | 0.040 | 0.025 | 0.020 | 0.091 | 0.085 | 0.047 |
| Saybolt Color | −16> | −16> | −16> | −16> | −16> | −16> | −16> | −16> | −16> |
| Second Step Hydro-treating Reaction Conditions: | | | | | | | | | |
| Catalyst | Co—Mo | Ni—Mo | Ni—Mo | Co—Mo | | | | Ni—Mo | Pt |
| $H_2$ Partial Pressure (kg/cm$^2$) | 60 | 60 | 60 | 60 | | | | 30 | 60 |
| Temp. (°C.) | 240 | 240 | 240 | 240 | | | | 240 | 240 |
| LHSV (hr$^{-1}$) | 8 | 8 | 8 | 8 | | | | 8 | 8 |
| $H_2$/oil (scf/bbl) | 2000 | 2000 | 2000 | 2000 | | | | 2000 | 2000 |
| Properties of Finished Oil: | | | | | | | | | |
| S (wt %) | 0.047 | 0.006 | 0.042 | 0.040 | | | | 0.085 | 0.047 |
| Saybolt Color | +18 | +11 | +23 | +9 | | | | −16> | −16> |

What is claimed is:

1. A process for the production of a low-sulfur diesel gas oil from a petroleum distillate having a sulfur content of 0.1 to 2.0% by weight and a boiling point of 150° to 400° C., the process comprising contacting the petroleum distillate with hydrogen in the presence of a hydro-treating catalyst which has at least one metal or its oxide or sulfide and a porous carrier, wherein said metal or its oxide or sulfide has a hydro-treating activity and is supported on said porous carrier, at a temperature of 350° to 450° C., and a pressure of 45 to 100 kg/cm$^2$ in the first step to thereby produce materials having a sulfur content of 0.05% by weight or lower, and contacting further the materials issued from the first step with hydrogen in the presence of a hydro-treating catalyst which has at least one metal or its oxide or sulfide and a porous carrier, wherein said metal or its oxide or sulfide has a hydro-treating activity and is supported on said porous carrier, at a temperature of 200° to 300° C., and a pressure of 45 to 100 kg/cm$^2$ in the second step to thereby produce the low-sulfur diesel gas oil having a Saybolt color number of −10 or higher and a sulfur content of 0.05% by weight or less, wherein the metal of the hydro-treating catalyst in each step is selected from the group consisting of chromium, molybdenum, tungsten, cobalt, nickel and iron, and wherein lighter fractions are not removed from the materials produced in the first step before said materials are subjected to the second step.

2. The method of claim 1 in which the temperature in the first step is 360°–400° C. and the pressure is 50–70 kg/cm$^2$, and the temperature in the second step is 220°–275° C. and the pressure is 50–70 kg/cm$^2$.

3. The process of claim 2 in which the temperature in the second step is 230°–250° C.

4. The process of claim 3 in which the petroleum distillate is a blend of a fluid catalytic cracking oil or a thermal cracking oil combined with a distillate obtained by topping or vacuum distillation of a crude oil.

5. The process of claim 1 in which the catalyst in each stage is selected from the group consisting of cobalt-molybdenum and nickel-molybdenum supported on alumina or silica-alumina.

6. The process of claim 1 in which the hydro-treating catalyst are presulfided.

* * * * *